United States Patent [19]

Read

[11] 4,390,996

[45] Jul. 5, 1983

[54] GARMENT

[76] Inventor: Stuart W. Read, 87 Malvern Rd., St. Johns, Worcester, England

[21] Appl. No.: 293,673

[22] Filed: Aug. 17, 1981

[30] Foreign Application Priority Data

Sep. 2, 1980 [GB] United Kingdom ..... 8028302

[51] Int. Cl.[3] ..... A41B 1/12

[52] U.S. Cl. ..... 2/70; 2/86

[58] Field of Search ..... 2/70, 86, 88, 93, 94

[56] References Cited

U.S. PATENT DOCUMENTS

| | | | |
|---|---|---|---|
| 2,073,485 | 3/1937 | Knowling | 2/86 |
| 2,130,690 | 9/1938 | Lemoine | 2/70 |
| 3,147,491 | 9/1964 | Fisch | 2/86 |
| 3,389,407 | 6/1968 | Morrison | 2/86 X |

FOREIGN PATENT DOCUMENTS

| | | |
|---|---|---|
| 505706 | of 0000 | Belgium . |
| 2181487 | of 0000 | France . |
| 2439593 | of 0000 | France . |
| 590624 | of 0000 | Switzerland . |
| 23207 | of 0000 | United Kingdom . |
| 175705 | of 0000 | United Kingdom . |

*Primary Examiner*—Doris L. Troutman

*Attorney, Agent, or Firm*—Owen, Wickersham & Erickson

[57] ABSTRACT

A garment comprising a jacket part comprising a body having a lower edge at crotch level and two arms extending from the body and a trouser part comprising two legs a part of the upper edge of each leg being permanently attached to the lower edge of the body and the remainder of the upper edge being releasably attached to the lower edge of the body by fastening means thereby to provide said one piece suit, the jacket and trouser parts each having co-operable retaining means whereby, when the fastening means are released and the trouser part folded relative to the jacket part, the trouser part may be retained between the upper and lower edges of the body by said retaining means, whereby the garment may be worn as a jacket only.

10 Claims, 2 Drawing Figures

GARMENT

BACKGROUND OF THE INVENTION

Field of the Invention

This invention relates to a garment, particularly, but not exclusively, a garment for use by a motorcyclist.

There is a need for a motorcyclist to have protection from rain and other inclement weather over the whole of his torso, arms and legs and also, when the weather is good, to have only protection for his upper torso and arms.

Hitherto it has been necessary to have either; separate garments for each such condition, that is to say, an all-in-one garment enveloping the arms, legs and the whole of the torso for inclement weather and an entirely separate garment such as an anorak or jacket covering only the upper torso and arms for good weather conditions, or; a garment comprising separate trousers and jacket. With either of these solutions the rider is left with the disadvantage of having a separate garment to dispose of. Either the all-in-one garment or the jacket or the like when one of them is being worn or the trousers when only the jacket is being worn.

The object of the present invention is to provide a new and improved garment which overcomes the above problem.

SUMMARY OF THE INVENTION

According to the invention we provide a garment comprising a jacket part comprising a body having a lower edge at crotch level and two arms extending from the body, a trouser part comprising two legs, a part of the upper edge of each leg being permanently attached to the lower edge of the body and the remainder of the upper edge being releasably attached to the lower edge of the body by fastening means thereby to provide said one piece suit, the jacket and trouser parts each having co-operable retaining means, means whereby when the fastening means are released and the trouser part folded relative to the jacket part, the trouser part may be retained between the upper and lower edges of the body by said retaining means, whereby the garment may be worn as a jacket only.

The jacket part may be provided with a pouch in which the trouser part can be received and retained by said retaining means.

The pouch may comprise a space between a main part of the jacket and a flexible flap attached to the jacket, or a part of the lining of the jacket.

Preferably, the flap is attached to the inside of the jacket but, if desired, the flap may be provided on the outside of the jacket.

Where the pouch is on the inside of the jacket, the flap or the lining may be made of a waterproof material.

The jacket may have an opening in the front thereof, closable by means of a zip fastener or alternatively buttons, press studs, strip fasteners such as those sold under the trade name VELCRO, or any other fastener means. Further, the flap may be attached to the inside of the jacket by buttons, zip fasteners or strip fasteners, press studs or by any other fastening means.

BRIEF DESCRIPTION OF THE DRAWINGS

The invention will now be described with the aid of the accompanying drawings in which.

DESCRIPTION OF THE PREFERRED EMBODIMENTS

Figure 1:
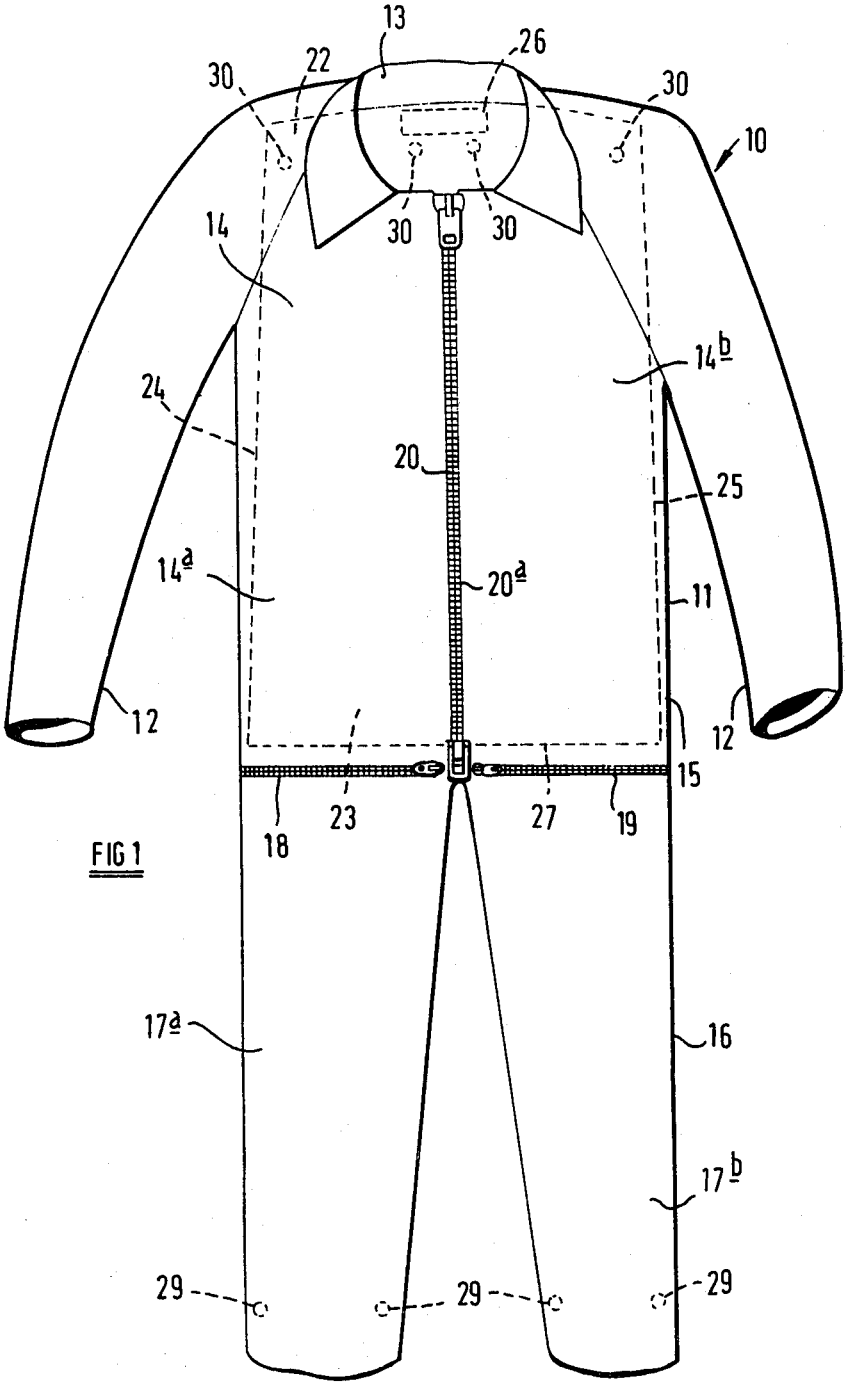
FIG. 1 is a drawing of a garment according to the invention comprising a combination of a jacket and a pair of trousers.

Referring to the drawings there is shown a motor cycle oversuit garment 10 comprising a combination of a jacket 11 having arms 12, neck 13, front 14 and back 15, and a pair of trousers 16 having legs 17$^a$, 17$^b$. The trousers 16 are permanently attached to the jacket 11 at the back 15 and are partially separable from the jacket 11 at the front 14 by means of two zip fasteners 18 and 19.

The jacket 11 has a front opening 20 with a fastener means comprising a zip fastener 20$^a$ which, when open, separates the front 14 into two parts 14$^a$ and 14$^b$.

Thus a person can, by undoing the zip fasteners 18, 19 and 20, put on the garment 10.

The jacket 11 further has a lining 22, a part 23 of which is stitched to the jacket 11 at one side as shown at 24 and is removably attached at the other side 25 and at the top 26 by strip fasteners 27 which are sold under the trade name VELCRO, but the part 23 is not attached at the bottom 27.

Thus the part 23 of the lining 22 is essentially a flap and is made of a waterproof material such as nylon, for the reason hereinafter appearing.

The main part of the jacket 11 and trousers 16 are also made of a waterproof material such as treated leather or nylon to protect the wearer, for example, against rain.

If the trousers 16 are not required, the wearer of the garment 10 may fold the trousers 16 into a space between the flap 23 and the back 15 of the jacket which provides a pouch, as follows.

The wearer first needs to remove the garment by undoing the zip fasteners 18, 19 and 20 and the garment 10 is then laid flat, as shown in FIG. 1.

Figure 2:
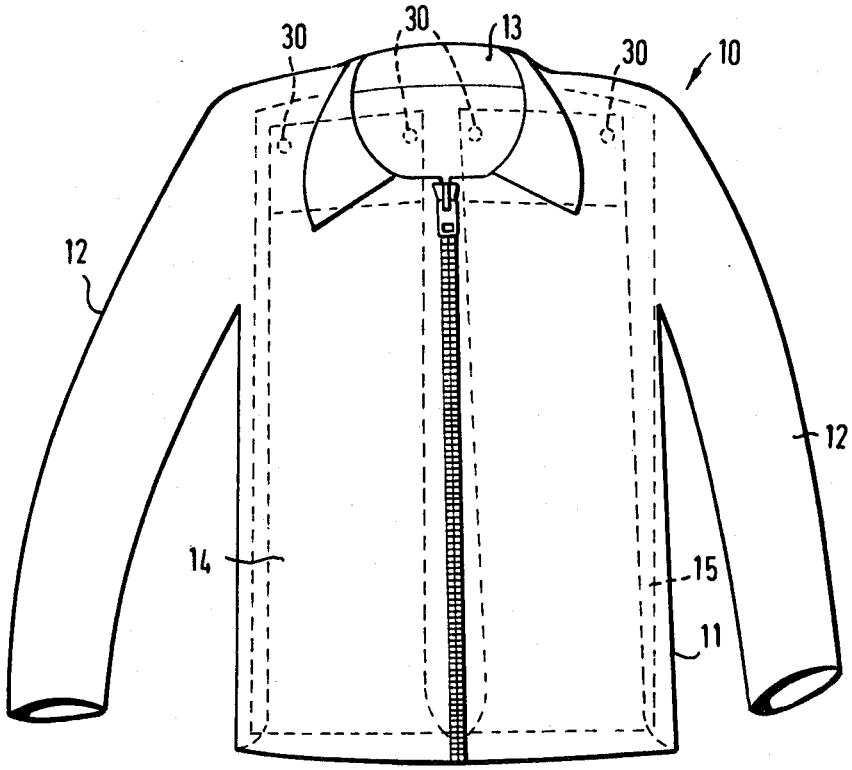
FIG. 2 is a drawing of the garment of FIG. 1 with the trousers received within a pouch of the jacket.

The front parts 14$^a$, 14$^b$ are then folded back and the strip fasteners 27 undone. The flap 23 is then folded back to the left as seen in the drawings. Next the trousers 16 are folded upwardly so that the legs 17$^a$, 17$^b$ of the trousers 16 lie in the position shown in FIG. 2. The legs 17$^a$, 17$^b$ are each provided adjacent their bottoms 28 with retaining fasteners comprising press studs 29 which, when the trousers 16 are folded to their FIG. 2 position, may be engaged with press studs 30 provided on the inside of the back 15 of the jacket to prevent the trousers 16 from subsequently falling down, in use, from the pouch.

The flap 23 is then closed and the strip fasteners 27 again fastened.

Thus the garment 10 may then be worn as a jacket only the trousers 16 being retained in the pouch between the flap 23 and the back 15 of the jacket 11.

As the flap 23 is waterproof, it is not necessary for the trousers to be dry when they are received within the pouch as the waterproof flap 23 will protect the wearer of the garment from the damp legs 17$^a$, 17$^b$.

Thus a motor cyclist may, when the weather is inclement for example, wear the jacket and trousers, and when the weather is fine, wear the garment 10 as a jacket only.

If desired, the trousers 16 may be completely separable from the jacket for example by providing a zip fastener which extends around the entire garment 10. Further, the fasteners 18, 19, 20 need not each comprise a zip, but if desired one or more may comprise buttons, Velcro strip fasteners or any other type of fastener.

Further, the flap 23 need not be secured to the inside of the jacket 11 by strip fasteners, and the retaining fasteners need not comprise press studs, but the fasteners may comprise zip fasteners, buttons or any other type of fastener.

Further it is within the scope of the invention to provide a pouch on the outside of the garment in which the trousers can be received.

Also, if desired, instead of a pouch, other means may be provided to receive and retain the trousers. For example if desired, retaining fastener means only may be provided without any flap lining or other means defining a pouch. Whilst such an arrangement does not have the advantage of providing protection for the wearer from wet trousers, such an arrangement may be desired in certain circumstances.

It is also within the scope of the invention for the securing of the trousers to the jacket to be by means and at locations other than that described hereinbefore. For example, the trousers could be arranged to be retained with one leg at each side of the jacket rather than at the rear as described hereinbefore.

Also, if desired, the lining of the jacket may be arranged so that it can be folded out and provided with fastener means so that it can be formed to provide the trousers. In this case, since it will be the interior of the legs which will be exposed to provide the inwardly facing surface of the lining, the wearer is protected from the wet exterior of the legs. In such an embodiment, the lining would be provided with fastener means and in two parts so that each part could be formed into a generally cylindrical shape and the meeting edges joined together by the fastening means to form a leg seam of a trouser leg.

I claim:

1. A garment comprises a jacket and a trouser part, the jacket comprising a body having a lower edge at or above crotch level, two arms extending from the body, the trouser part comprising two legs, part of the upper edge of each leg being permanently attached to the lower edge of the body and the remainder of the upper edge being releasably attached to the lower edge of the body by fastening means thereby to provide a one piece suit, the jacket and trouser part each having co-operable retaining means whereby, when the fastening means are released and the trouser part folded relative to the jacket, the trouser part may be retained between the upper and lower edges of the body by said retaining means, whereby the garment may be worn as a jacket only.

2. A garment according to claim 1 wherein the jacket is provided with a pouch in which said trouser part may be received and retained by said retaining means.

3. A garment according to claim 2 wherein the pouch comprises a space between a main part of the jacket and a flexible flap attached to the jacket.

4. A garment according to claim 3 wherein the flap is attached to the inside of the jacket.

5. A garment according to claim 4 wherein the flap is attached to the jacket by buttons, zip fasteners, strip fasteners, or press studs.

6. A garment according to claim 3, claim 4 or claim 5 wherein the flap is made of a waterproof material.

7. A garment according to claim 2 wherein the pouch comprises a space between a main part of the jacket and a part of the lining of the jacket.

8. A garment according to claim 7 wherein the lining part is made of a waterproof material.

9. A garment according to claim 1 wherein the jacket has an opening in the front thereof, closable by fastener means.

10. A garment according to claim 9 wherein the opening in the front of the jacket is closable by means of a zip fastener.

* * * * *